US006115660A

United States Patent [19]

Berger et al.

[11] Patent Number: 6,115,660

[45] Date of Patent: Sep. 5, 2000

[54] ELECTRONIC COORDINATED CONTROL FOR A TWO-AXIS WORK IMPLEMENT

[75] Inventors: Alan D. Berger, Winfield; Ketan B. Patel, Naperville, both of Ill.

[73] Assignee: Case Corporation, Racine, Wis.

[21] Appl. No.: 08/978,669

[22] Filed: Nov. 26, 1997

[51] Int. Cl.[7] ..... G06F 19/00

[52] U.S. Cl. ..... 701/50

[58] Field of Search ..... 701/50; 414/710, 414/697, 699; 172/2, 4; 37/907

[56] References Cited

U.S. PATENT DOCUMENTS

| | | |
|---|---|---|
| 3,726,428 | 4/1973 | Lark et al. . |
| 3,924,766 | 12/1975 | Canning . |
| 4,006,481 | 2/1977 | Young et al. . |
| 4,129,224 | 12/1978 | Teach . |
| 4,231,700 | 11/1980 | Studebaker . |
| 4,288,196 | 9/1981 | Sutton . |
| 4,537,029 | 8/1985 | Gunda et al. . |
| 4,712,376 | 12/1987 | Hadank et al. . |
| 4,757,454 | 7/1988 | Hisatake et al. . |
| 4,831,539 | 5/1989 | Hagenbuch . |
| 4,839,835 | 6/1989 | Hagenbuch . |
| 4,844,685 | 7/1989 | Sagaser . |
| 4,964,779 | 10/1990 | Sagaser . |
| 5,160,239 | 11/1992 | Allen et al. . |
| 5,182,908 | 2/1993 | Devier et al. . |
| 5,220,968 | 6/1993 | Weber . |
| 5,305,681 | 4/1994 | Devier et al. . |
| 5,327,347 | 7/1994 | Hagenbuch . |
| 5,383,390 | 1/1995 | Lukich . |
| 5,424,623 | 6/1995 | Allen et al. . |
| 5,434,785 | 7/1995 | Myeong-hun et al. . |
| 5,438,771 | 8/1995 | Sahm et al. . |
| 5,462,125 | 10/1995 | Stratton et al. . |
| 5,469,356 | 11/1995 | Hawkins et al. . |
| 5,475,561 | 12/1995 | Goeckner et al. . |
| 5,501,570 | 3/1996 | Mozingo . |
| 5,516,249 | 5/1996 | Brimhall . |
| 5,527,156 | 6/1996 | Song . |
| 5,528,499 | 6/1996 | Hagenbuch . |
| 5,532,529 | 7/1996 | Codina et al. . |
| 5,537,818 | 7/1996 | Hosseini et al. . |
| 5,617,723 | 4/1997 | Hosseini et al. . |
| 5,701,793 | 12/1997 | Gardner et al. ..... 91/361 |
| 5,899,008 | 5/1999 | Cobo et al. ..... 37/348 |

FOREIGN PATENT DOCUMENTS

| | | |
|---|---|---|
| 0 258 819 A1 | 3/1988 | European Pat. Off. . |
| 0 310 674 A1 | 4/1989 | European Pat. Off. . |
| 0 604 402 A1 | 6/1994 | European Pat. Off. . |
| 0 632 167 A2 | 1/1995 | European Pat. Off. . |
| 0 791 694 A1 | 8/1997 | European Pat. Off. . |
| 0 796 952 A1 | 9/1997 | European Pat. Off. . |
| WO 92/11418 | 7/1992 | WIPO . |
| WO 94/26988 | 11/1994 | WIPO . |

*Primary Examiner*—Michael J. Zanelli
*Attorney, Agent, or Firm*—Foley & Lardner

[57] ABSTRACT

A loader of the type controlled with an electronic digital controller is disclosed herein. The loader may include conventional mechanical component. However, the hydraulic valve is electronically controlled to provide improved motion control. In particular, the operator controls the loader with a two-axis joystick. When the joystick is moved left or right, the bucket is rolled at a speed proportional to the rate of change of the joystick position and independent of the loader arms. When the joystick is moved forward or backwards, the loader arms of the bucket are raised or lowered. When the joystick is only moved forward or backward with substantially no component of motion left or right, the controller rolls the bucket to maintain a substantially constant angle between the bucket and the surface upon which the loader is operating.

25 Claims, 5 Drawing Sheets

ELECTRONIC COORDINATED CONTROL FOR A TWO-AXIS WORK IMPLEMENT

FIELD OF THE INVENTION

The present invention relates to controlling the motion of an implement which is moveable about at least two axes. In particular, the present invention relates to an electronic control which permits an operator to coordinate the motion of two axes of a work implement such as the arm and bucket motions of a loader.

BACKGROUND OF THE INVENTION

A known implement having at least two axes and which is operated by providing control about the axis is a loader/bucket arrangement of the type used on tractors, skid steer vehicles, articulated vehicles, and tracked vehicles. Such an arrangement typically includes two arms pivotally attached to the vehicle at one end of the arms and a bucket pivotally attached at the distal end of the arms. The arms are typically pivoted relative to the vehicle by hydraulic cylinders appropriately attached thereto to raise and lower the bucket. The bucket is pivoted relative to the arms by hydraulic cylinders appropriately attached thereto.

The power to actuate the hydraulic cylinders which produce the pivoting motion of the loader arms and bucket about their respective pivot axes is provided by hydraulic fluid supplied to the cylinders by an appropriate pump or pumps. The flow of hydraulic fluid is controlled by valves which may be manually, electrically, or electromechanically operated.

For many uses of loaders, it is desirable to maintain the orientation of the bucket relative to the surface upon which the associated vehicle is operating while the loader arms are being raised or lowered. In certain conventional systems, to achieve this result, the operator must control the valve for the hydraulic cylinders of the loader arms ("Arm Valve") while simultaneously controlling the valve for the hydraulic cylinder of the bucket ("Bucket Valve"). This simultaneous control of the Arm and Bucket Valves requires that the operator maintain visual contact with the bucket, which on certain vehicles is difficult. In many situations, the vehicle and loader configuration will not permit the operator to properly determine the orientation of the bucket through the full range of motion of the bucket.

In response to this need for a loader arrangement which can be operated to maintain the orientation of the bucket relative to the surface over which the bucket is being raised and lowered, loaders have been designed to include self-leveling linkages which serve to maintain the orientation of the bucket. Alternatively, some loaders have been designed to combine the operation of the Arm and Bucket Valves to provide improved bucket orientation control. One problem with many of the presently used arrangements for bucket orientation control is the complexity of such arrangements. This complexity increases cost and, in most cases, reduces reliability. Another problem with certain existing systems is the utilization of operator controls which are not easily and efficiently manipulated by the operator to achieve desired loader operations.

In view of the need for improved bucket control and the drawbacks with many existing systems, it would be desirable to provide an improved electronic system useable by an operator to effectively control the orientation of the arms and bucket of a loader or other implement requiring coordinated control about at least two axes.

SUMMARY OF THE INVENTION

The present invention provides a motion control for an implement, such as, a loader used with a vehicle, e.g., a construction or agricultural vehicle. In the case of a loader, the control includes a first position sensor which generates a signal representative of the position of the loader arms relative to the vehicle, and a second position sensor which generates a signal representative of the position of the attachment (e.g. bucket, pallet forks, cold planer, hammer, etc.) relative to the arms. The control also includes an input device, such as, a joystick, to provide an operator interface which permits the operator to simultaneously or independently cause the control to pivot the arms relative to the vehicle or to pivot the implement relative to the arms. The input device includes a signal generator for generating a control signal representative of device motion about a first axis and a signal generator for generating a control signal representative of device motion about a second axis. A hydraulic valve assembly responsive to electric signals is provided to control hydraulic fluid flow to hydraulic actuators (e.g. cylinders) which pivot the arms and implement.

The intelligence for the motion control is provided by a digital control circuit coupled to the sensors, to the input device, and to the hydraulic valve assembly. The control circuit applies the valve signals to the valve assembly such that hydraulic fluid flow is applied to the hydraulic actuators to pivot the arm so that the associated position signal and the associated control signal from the device maintain a first predetermined relationship, and the hydraulic actuator associated with the attachment pivots the attachment so that the associated position signal and the associated control signal maintain a second predetermined relationship. When the input device is manipulated by the operator such that a control signal is generated only as a result of motion about the first axis, the control circuit generates a valve signal which controls the hydraulic actuator for the attachment independent of the signal generated by the input device. More specifically, the attachment is pivoted to maintain a third predetermined relationship between the attachment and the surface upon which the vehicle is resting, while the arms are pivoted by their associated hydraulic actuators.

The present invention also relates to a vehicle which includes the loader arrangement and motion control described above. By way of example, such a vehicle may be a tractor, a tracked vehicle which includes wheels which guide the tracks and support the vehicle, a skid steer vehicle, or an articulated vehicle. Depending upon the application for which the implement is used, the first and second predetermined relationships may be based upon proportional control, integral control, derivative control, or a combination of these and other control schemes. The third relationship is typically to maintain a predetermined angle between the attachment and the surface. For example, where the attachment is a pair of lifting forks, the angle can be set to lift pallets or other objects at a constant angle (e.g. 0 degrees) with the surface upon which the vehicle is operating. Where the attachment is a bucket, the predetermined relationship may take the form of an angle that changes as the arms are raised (e.g. rolling the bucket in to improve bucket filling when loading from a material pile).

BRIEF DESCRIPTION OF DRAWINGS

The invention will hereafter be described with reference to the accompanying drawings, wherein like numerals denote like elements and.

DETAILED DESCRIPTION OF THE PREFERRED EMBODIMENT

Figure 1:
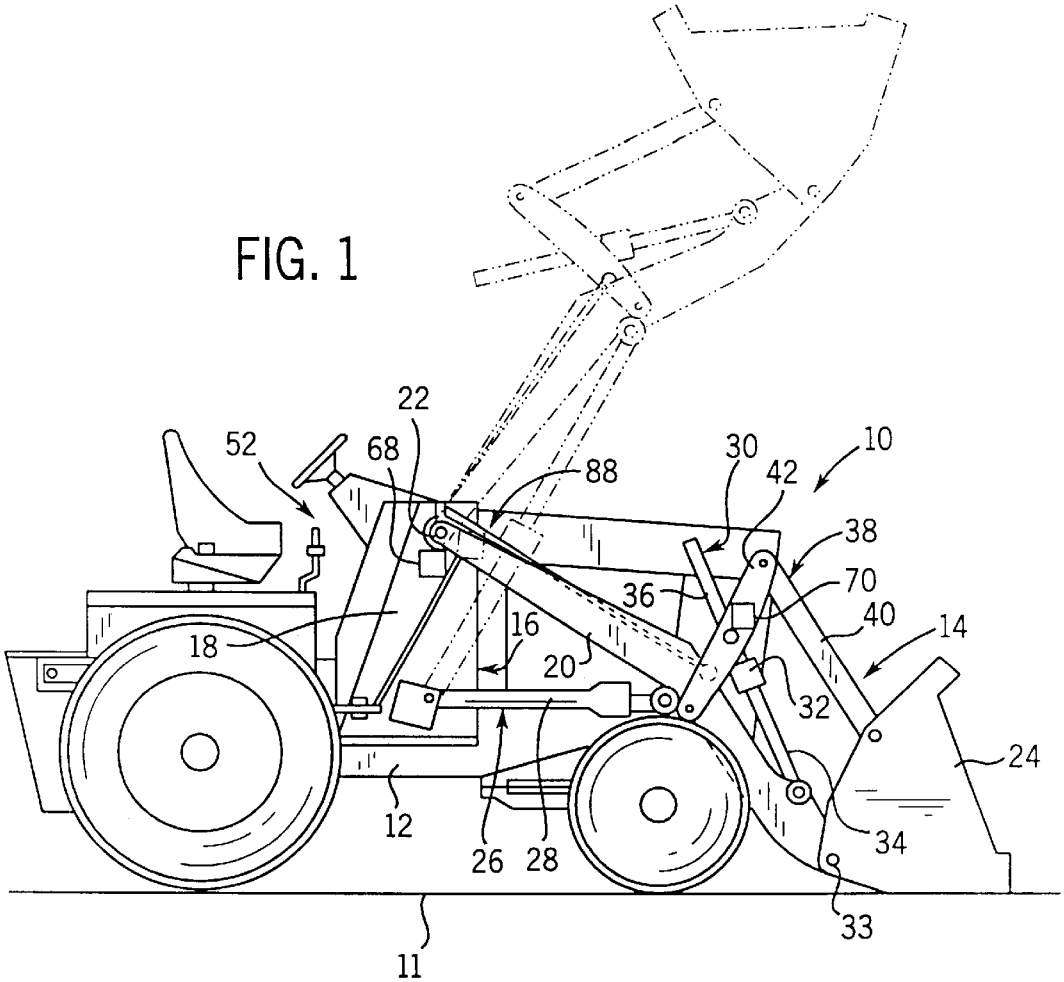
FIG. 1 is a side elevational view of an off-road work vehicle, including a loader mechanism.

With reference to FIG. 1, loader 10 for an off-road vehicle such as a tractor, bulldozer, skid steer, or articulated vehicle is shown. In one embodiment, loader 10 is preferably configured to be a two-axis implement supported by a mobile main frame 12 onto which is mounted a loader mechanism 14. Mobile main frame 12 is movably supported by wheels 13 on a surface 11 that supports a bucket 24. Mobile main frame 12 further supports an engine (not shown) that ultimately drives wheels 13 to move on surface 11. The loader 10 may include a frame 16 that is attached to the vehicle permanently or removeably. The frame 16 supports loader 10 and includes a pair of vertically upstruck supports 18 (only one is shown) arranged on opposite lateral sides of the implement frame 12.

Loader 10 further includes a pair of generally parallel loader arms 20. Each loader arm 20 is coupled by a pivot shaft 22 to an upper end of a respective support 18. A bucket 24 is pivotally coupled to and between the distal ends of loader arms 20.

Each loader arm 20 is angularly displaced relative to frame 12 and is pivoted about pivot shaft 22 via a suitable lift actuator 26 coupled between the respective loader arm 20 and support 18. A pair of extendable/retractable loader arm hydraulic cylinders 28 (only one is shown) is used to angularly position loader arms 20 and, thereby, bucket 24 relative to frame 12. Hydraulic pressure can be applied to either end of hydraulic cylinders 28. When hydraulic pressure is applied to the piston end, loader arm cylinders 28 are extended, and loader arms 20 are raised by pivoting about pivot shaft 22. Conversely, when pressure is applied to the rod end, the loader arm cylinders 28 retract, and loader arms 20 are pivoted in the opposite direction to lower bucket 24 attached to each distal end of loader arms 20.

Bucket 24 is pivoted or rolled between loading and unloading positions by a pivot assembly 14. Assembly 14 includes at least one tilt actuator 30. The tilt actuator 30 includes an extendable/retractable bucket hydraulic cylinder 32. Furthermore, a piston rod 34 of bucket cylinder 32 is articulately coupled to loader arms 20, while a cylinder portion 36 of bucket hydraulic cylinder 32 is coupled to bucket 24 through a bucket positioning linkage 38. Bucket positioning linkages 38 are generally the same for both loader arms 20 (only one is shown).

Bucket position linkage 38 includes a forward bucket link 40, one end of which is pivotally secured to bucket 24, and the opposite end of which is pivotally coupled to the end of a rear bucket link 42. The opposite end of the rear bucket link 42 is pivotally coupled to an intermediate portion of loader arm 20. As a result, pivotal movement of the rear bucket link 42 causes pivotal or rolling movements of bucket 24 relative to loader arms 20. To effect movement of the rear bucket link 42, the cylinder portion 36 of hydraulic bucket cylinder 32 is pivotally coupled to an intermediate portion of rear bucket link 42.

Application of hydraulic pressure to the piston end of bucket cylinder 32 causes bucket 24 to pivot or to roll rearwardly relative to lift arms 20, i.e., to roll back from the dump position to a carry or a level position. Conversely, application of hydraulic pressure to the rod end of bucket cylinder 32 causes bucket 24 to pivot or to roll forwardly. The two bucket positioning linkages 38 operate simultaneously to bring about the desired movement.

Figure 2:
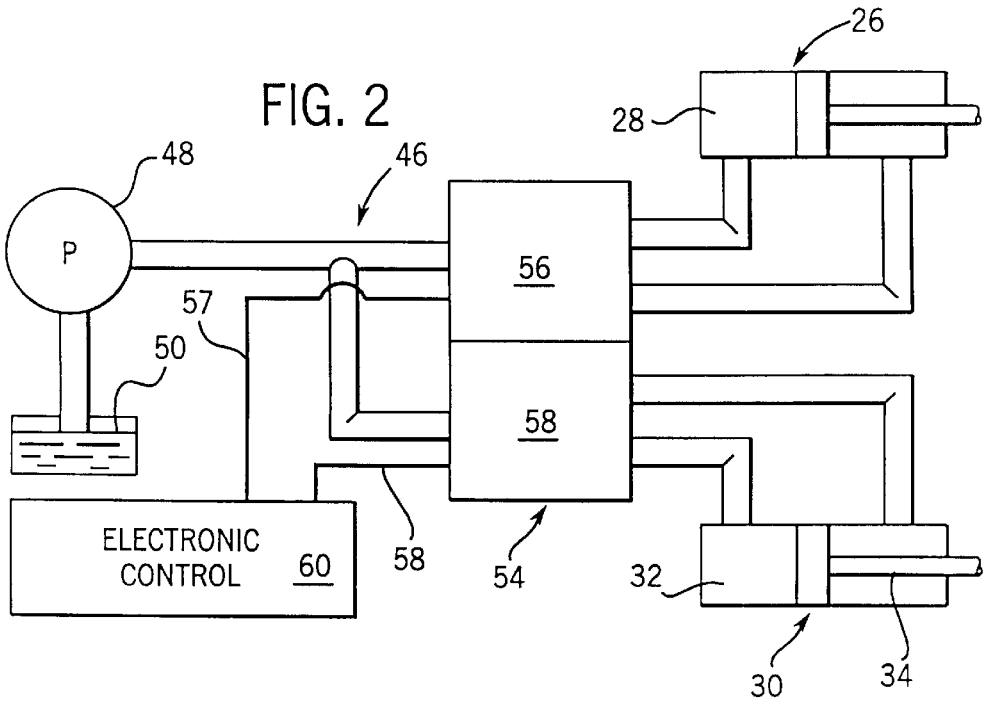
FIG. 2 is a schematic diagram of the hydraulic circuitry associated with the loader mechanism shown in FIG. 1.

With reference to FIG. 2, a hydraulic system 46 for operating loader 10 is coupled to loader arm cylinders 28 and bucket cylinder 32. System 46 further includes a pressurized hydraulic fluid source, such as, a pump 48, which is coupled to the engine and which draws fluid from a sump 50 arranged on frame 12 (FIG. 1). Hydraulic fluid flow through hydraulic system 46 and to and from loader arm cylinders 28 and bucket cylinder 32 in a manner operating loader mechanism 14 is effected through an electronic control system 60 coupled to a solenoid-operated, hydraulic valve assembly 54 by signal conductors 57 and 58. Electronically controlled hydraulic valve assembly 54 further includes a loader arm lift valve 56 and a bucket tilt valve 58.

Hydraulic valve assembly 54 is connected to the pressurized fluid source 48 and is preferably mounted on frame 12. Loader arm lift valve 56 includes a valve stem (not shown) which linearly positions a spool valve (not shown), thereby regulating hydraulic fluid flow through valve 56 and controlling the "operative length" of loader arm cylinders 28. In particular, the operative length of loader arm cylinders 28 controls the angular disposition of loader arms 20 relative to frame 12. Similarly, tilt valve 58 also includes a valve stem (not shown) which linearly positions a spool valve (not shown), thereby regulating fluid flow through valve 58 and controlling the "operative length" of bucket cylinder 32. In particular, the operative length of bucket cylinder 32 controls the pivotal disposition of bucket 24 relative to loader arms 20. In the present embodiment, "operative length" refers to the effective distance between those locations on the respective cylinder or actuator which regulate the position of the particular mechanism coupled thereto.

In general, loader 10 is a two-axis work implement. Each axis is generally representative of an associated loader 10 motion. For instance, the first axis may represent primarily independent loader arm movement (e.g. rotation of arms 20 about shafts 22), with bucket 24 just following loader arms 20, and the second axis may represent mainly independent bucket movement (e.g. rotation about bucket pins 33 which attach bucket 24 to arms 20). Motion of loader 10 is controlled by control system 60.

In general, system 60 is programmed to coordinate the motion of both axes of the two-axis work implement, i.e., loader arms 20 and bucket 24 of loader system 10. For example, system 60 can maintain the orientation of the second axis, e.g., bucket 24, while the first axis, e.g., loader arms 20, is moved.

Figure 3:
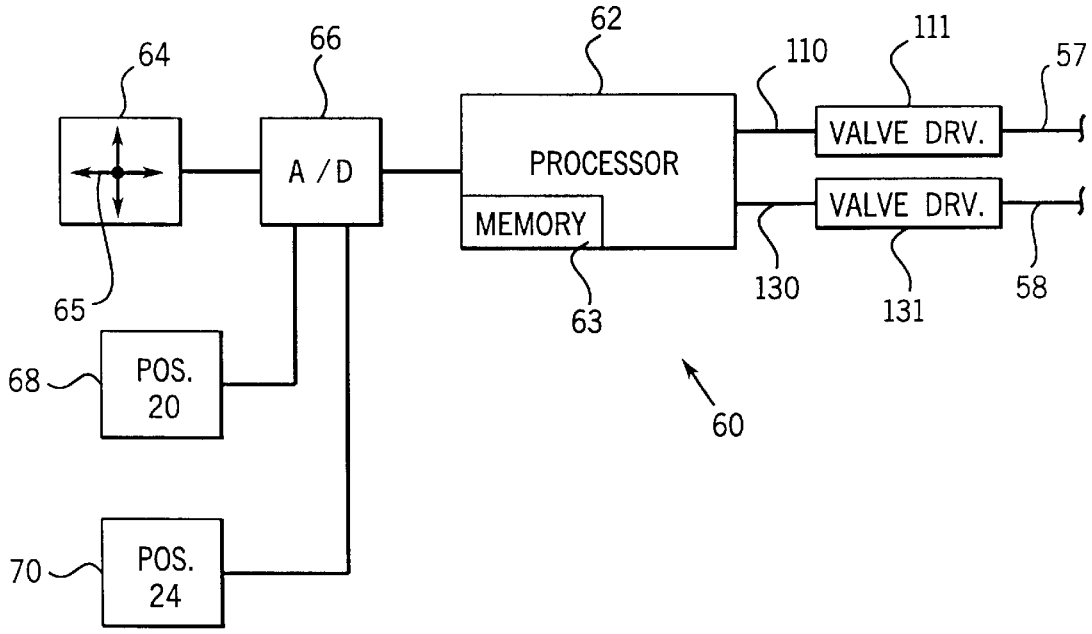
FIG. 3 is a schematic block diagram of an electronic control for the hydraulics of the loader mechanism.

Referring to FIG. 3, system 60 includes a digital processor 62 including memory 63, a valve driver circuit, and a microprocessor (e.g. Intel 80186) coupled to a signal input device such as a two-axis joystick 64, by an appropriate analog-to-digital converter 66. (Converter 66 may be separate, from or integrated with either of processor 62 or joystick 64.)

Joystick includes a lever 65 moveable by an operator about two axes. Joystick 64 includes a first signal generator for generating a first control signal representative of lever movement about the first axis and a second signal generator for generating a second control signal representative of lever movement about the second axis. More specifically, each signal generator is preferably a respective potentiometer that is coupled to the joystick lever, whereby a voltage change is generally representative of the magnitude and the direction (i.e., either a positive or a negative voltage change) of motion of the joystick lever about a corresponding axis. In the present embodiment, the first signal generator is a first potentiometer coupled to the lever to operate in response to motion of the joystick lever about the first axis. Similarly, the second signal generator is a second potentiometer coupled to the lever to operate in response to motion of the joystick lever about the second axis.

In one embodiment, the two axes are defined with reference to the direction of displacement of joystick lever 65 from the center position, e.g., a zero value. In particular, the first axis is preferably defined as either forward or backward displacement of the joystick lever from the center position (see FIG. 3), whereby positive values reflect forward motion, while negative values reflect backward motion. Similarly, the second axis is preferably defined as either right or left displacement of the joystick lever from the center position (see FIG. 3), whereby positive values reflect motion to the right, while negative values reflect motion to the left. Additionally, movement of the joystick lever about a particular axis correlates to movement of an associated function in loader system 10, i.e., first axis movement of the joystick lever generally correlates to movement of arms 20 (i.e. operation of cylinders 28), whereas second axis movement of the joystick lever generally corresponds to movement of bucket 24 (i.e. operation of cylinder 30).

System 60 also includes at least one loader arm position feedback sensor 68 (e.g. potentiometer which generates a voltage representative of angular position). Since both loader arms 20 generally move synchronously in the same direction, one position sensor provided on either loader arm 20 will typically be sufficient. Sensor 68 is preferably disposed at pivot shaft 22 of loader arm 20 via a linkage to measure the angle of arm 20 relative to frame 12. The linkage may provide a mechanical advantage which causes sensor 68 to generate a signal which is a function (e.g. proportional to) of the distance of cylinder extension. Sensor 68 is coupled to A/D 66 which generates a loader arm position signal 108 (an angular measurement of the orientation of loader arms 20 relative to surface 11) used by processor 62 in the control described in reference to FIGS. 4–6. Some preprocessing of the raw position provided by sensor 68 may be needed to derive loader arm position signal 108, e.g., a correction based on the actual physical location of sensor 68 relative to pivot pin 22 of the loader arm onto which it is provided.

System 60 further includes at least one bucket position feedback sensor 70. Sensor 70 is preferably coupled between rear bucket link 42 and hydraulic cylinder 32 to generate a signal representative of the angle of bucket 24 relative to arms 20 about pins 33. Sensor 70 is coupled to A/D 66 which generates a bucket position signal 120 used by processor 62 in the control described in reference to FIGS. 4–6. Bucket position signal 120 is preferably an angular measurement of the orientation of bucket 24 relative to loader arms 20. Some processing of the signal generated by sensor 70 may be needed to derive bucket position signal at 120, e.g., a correction based on the actual physical location of the position sensor relative to the pivot point of the bucket and the specific geometry of pivot assembly 14.

By way of modification, sensors 68 and 70 may be of the type which generate signals representative of linear positions. Such sensors would be coupled to cylinders 26 and 32. By way of example, sensors 68 and 70 may include a micro-power impulse radar (MIR) generator, sensor and timing circuit of the type available from Laurence Livermor Labs. In general, the MIR system is attached to cylinders 26 and 32 to measure cylinder piston position. Furthermore, the timing circuit may be configured to generate a piston position signal wherein A/D 66 is not required for converting the signals from sensors 68 and 70. With an arrangement using an MIR system, the rotational orientation of surface 11, arms 20, bucket 24 and vehicle frame 12 relative to each other, can be calculated based upon the geometry of the components of loader 10.

Based upon the signals generated by joystick 64 and sensors 68 and 70, processor 60 generates appropriate valve command signals that are sent to the solenoids of hydraulic valve assembly 54. The valve command signals generated by the digital control circuit are preferably configured to be pulse-width-modulated (PWM) signals since the hydraulic valve assembly 54 is also preferably configured to include PWM valves, i.e., loader arm valve 56 and bucket valve 58 are preferably PWM valves. In response to the particular valve command signal received, hydraulic valve assembly 54 then directs hydraulic fluid flow to loader arm hydraulic cylinder 28 and/or to bucket hydraulic cylinder 32 to effect the pivoting of loader arms 20 or bucket 24, alone or in combination.

Figure 4:
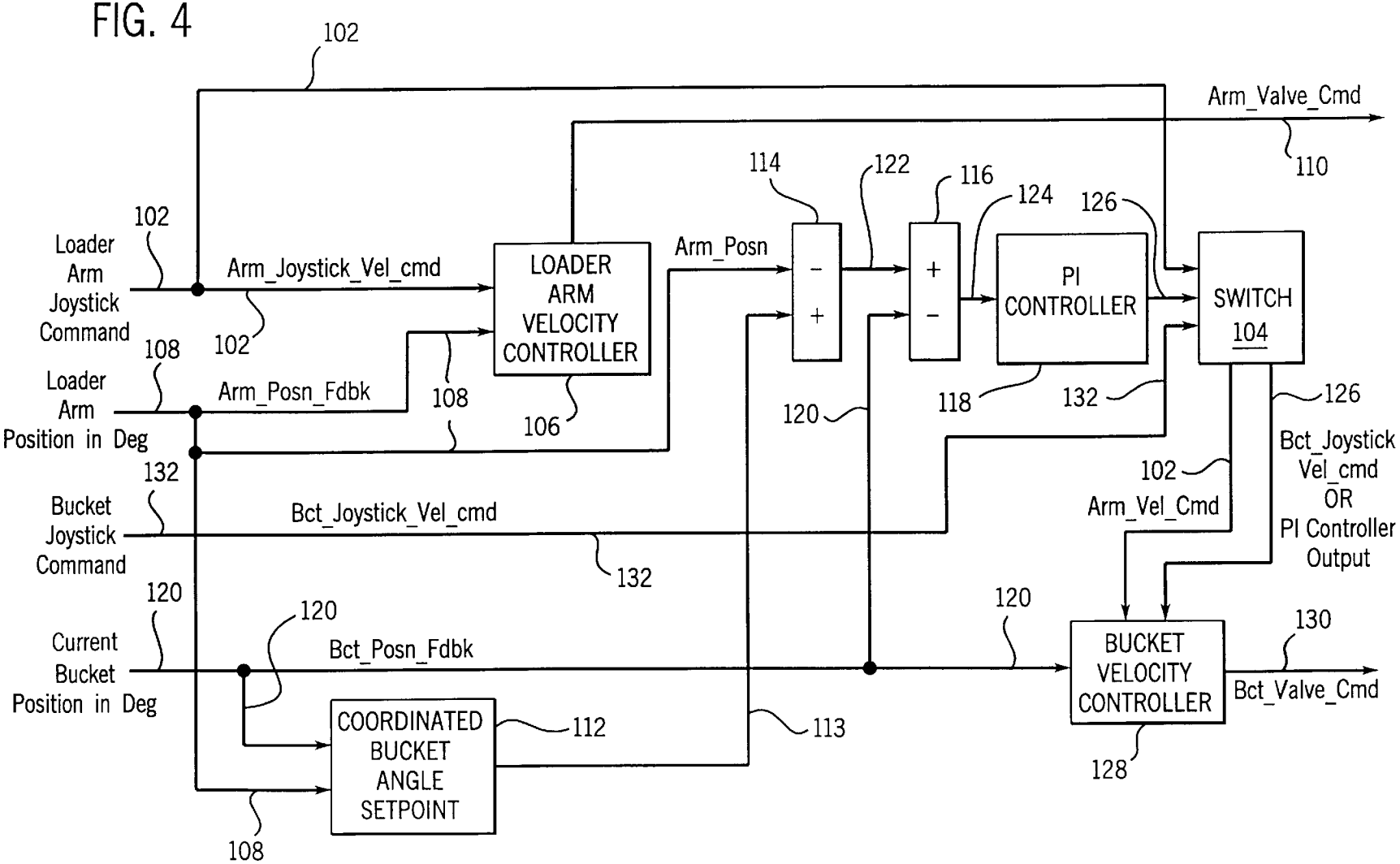
FIG. 4 is a schematic block diagram of the coordinated control circuit of the electronic control which controls the loader mechanism of FIG. 1 by regulating the hydraulic circuitry illustrated in FIG. 2.

With reference to FIG. 4, processor 62 is programmed to provide the control circuit of System 60 as shown. System 60 advantageously utilizes the components described above to operate loader system 10 in various functional modes. In one embodiment, system 60 provides three modes of operation: independent loader arm control, coordinated control, and independent bucket control.

Independent loader arm control mode is active when there is movement of the joystick lever about the first axis, with substantially no lever movement about the second axis, to generate the first control signal, i.e., the loader arm velocity signal at input 102. Signal 102 is applied to a switch box 104 and a loader arm velocity controller 106. (Controller 106 is described in detail below in reference to FIG. 5.) Loader arm velocity controller 106 also receives signal 108 generated from loader arm position sensor 68. Signal 108 provides the angular position of loader arms 20 relative to surface 11.

Loader arm velocity controller 106 integrates signals 102 and 108. More specifically, loader arm velocity controller 106 integrates the signals to preferably maintain a substantially proportional predetermined relationship between loader arm position signal 108 and loader arm velocity signal 102. Based upon signals 102 and 108, controller 106 then generates a loader arm valve signal 110.

Arm valve signal 110 is preferably configured to be a PWM signal applied to valve driver 111 (see FIG. 3) which provides amplification, conditioning and isolation to the signal to properly operate the electric solenoid for valve 56. In response, valve 56 directs hydraulic fluid flow to corresponding hydraulic cylinders 28, which are associated with loader arms 20. Hydraulic cylinders 28 then move the loader arms 20 to pivot as needed to maintain the predetermined relationship between loader arm position signal 108 and loader arm velocity signal at input 102. Furthermore, hydraulic cylinders 28 also pivot loader arms 20 to maintain the rate of change of loader arm position signal 108 substantially proportional and integral with the rate of change of loader arm joystick signal 102. Ultimately, loader arms 20 pivot from their current position to the desired position required by the operator, as indicated by the degree of motion of lever 65 about the first axis.

Operator control of bucket 24 typically includes movement of joystick 64 about both the first and the second axes. Depending upon the motion of the joystick lever 65, control of bucket 24 will be in the independent bucket control mode or the coordinated control mode. Independent bucket control mode is active when there is lever 65 movement about the second axis, with substantially no lever 65 movement about the first axis. In contrast, coordinated control mode is active when there is lever 65 movement about the first axis, with substantially no lever 65 movement about the second axis. As discussed in further detail below, in the coordinated control mode, system 60 operates to maintain the orientation of bucket 24 with respect to surface 11 substantially constant when lever 65 is moved only about the first axis.

Since loader arms 20 are the sole support for pivot assembly 14 and bucket 24, any first axis movement of loader arms 20 also involves movement of bucket 24, even with no joystick lever 65 movement about the second axis. For example, to prevent accidental spillage of contents between loading and unloading operations, it is desirable to maintain bucket 24 in a generally leveled position relative to surface 11 (e.g. level) as loader arms 20 are either raised or lowered. The coordinated control mode and the independent loader arm control mode preferably work together to coordinate bucket movement with loader arm movement such that bucket 24 maintains a predetermined orientation relative to frame 12 (i.e. surface 11). More specifically, a substantially constant angle is preferably maintained between bucket 24 and surface 11 while loader arms 20 are either raised or lowered in response to movement of lever 65 about the first axis, with substantially no movement about the second axis.

Turning more specifically to the coordinated control mode, processor 62 is programmed to provide a coordinated bucket angle setpoint circuit 112, a first summer circuit 114, a second summer circuit 116, and a PI (proportional-integrator) control circuit 118. The feedback signal 108 generated from loader arm position sensor 60 is applied to circuits 106, 112 and 114. Circuit 112 further receives bucket feedback signal 120 from the bucket position sensor 70 to indicate the current position of bucket 24 relative to loader arms 20.

Circuit 112 preferably stores the sum of the value of signal 120 value of signal 108. Since radial-coordinated motion seeks to hold the sum of the bucket angle and the loader arm angles constant, the values of signals 108 and 120 are converted to angle values ($\phi_{bucket}$ and $\phi_{arms}$) stored in memory 63. Furthermore, a resultant angle constant ($\phi_{constant}$) is generated based upon the equation: $\phi_{constant}=\phi_{bucket}+\phi_{arms}$.

Coordinated bucket angle setpoint circuit 112 preferably calculates and stores $\phi_{constant}$ in memory 63 at the conclusion of any independent bucket operation. $\phi_{constant}$ may also be computed during every inactive phase of loader control. Therefore, $\phi_{bucket}$ and $\phi_{arms}$ for the above equation correspond to the bucket and arm angles at the conclusion of any independent bucket operation. Thus, circuit 112 stores $\phi_{constant}$ calculated at the end of each bucket operation.

$\phi_{constant}$ is applied to first summer circuit 114 at input 113. Circuit 114 further receives the angle value of signal 108 to indicate the current position of loader arms 20 relative to surface 11, i.e., $\phi_{arms}$. In circuit 114, $\phi_{arms}$ is preferably assigned a negative value, whereas $\phi_{constant}$ is preferably designated a positive value. As a result, circuit 114 subtracts the current loader arm position ($\phi_{arms}$) from the stored angle constant ($\phi_{constant}$) to derive a new bucket position ($\phi_{bucket}$). The new bucket position is applied to the input 122 of a second summing circuit 116.

Circuit 116 further receives the angle value of signal 120 from sensor 70 to provide the current position of bucket 24 relative to loader arms 20. Circuit 116 assigns a positive value to the new $\phi_{bucket}$, whereas the current angle value of signal 120 ($\phi_{bucket}$) is preferably designated a negative value. Circuit 116 then subtracts the previous value of $\phi_{bucket}$ from the current value of $\phi_{bucket}$ to create an error signal at output 124. More specifically, the error signal at output 124 is the angular difference between the desired bucket angle generated from circuit 114 and the current bucket angle generated by the bucket position sensor 70. This difference requires correction to maintain the constant angle $\phi_{constant}$ stored in memory 63.

The error signal on output 124 is provided to and manipulated by a proportional-integral (PI) controller 118. PI controller 118 subsequently generates a velocity signal at output 126 which is applied to a bucket velocity controller 128 via a switch box 104. In particular, the bucket velocity signal at output 126 generated by PI controller 118 is representative of the velocity that bucket 24 needs to acquire in order to force the error signal at output 124 to zero, and is proportional to the integral of the error signal (e.g. bucket velocity command=$\int K\times error$) at output 124. The proportionality constant depends upon the size and configuration of loader 10. Moreover, PI controller 118 generally updates the needed bucket velocity signal on a continuous basis, i.e., PI controller 118 constantly adapts to new conditions. By way of example, processor 62 executes the program which provides the circuit functions shown in FIGS. 4–6 every millisecond. Thus, in the preferred embodiment, each of the functions is performed periodically at a rate of once per millisecond.

In addition to the velocity signal issued by PI controller 118, switch box 104 also receives loader arm joystick velocity signal on input 102. Hence, the loader arm velocity signal at input 102 and the PI controller velocity signal at input 126 are not altered by switch box 104. Switch box 104 selectively applies the PI controller velocity signal at input 126 and the loader arm velocity signal at input 102 to bucket velocity controller 128. (The switch box function will be further discussed with reference to independent bucket control mode.) Bucket velocity controller 128 subsequently integrates both signals and generates a bucket valve signal at output 130.

The bucket valve signal at output 130 is preferably configured to be a PWM signal which is applied to hydraulic valve assembly 54. The PWM signal is applied to a valve driver circuit 131 (see FIG. 3) which provides amplification, conditioning and isolation to the signal to properly operate the electric solenoid for valve 58. In response to the signal from driver 131, valve 58 controls hydraulic fluid flow to the corresponding hydraulic cylinder 32. Cylinder 32 then drives bucket 24 to follow loader arms 20 and to pivot to maintain the predetermined orientation with respect to surface 11. More specifically, cylinder 32 drives bucket 24 to synchronously move at the same velocity as loader arms 20 and to pivot such that a constant angle is maintained between bucket 24 and surface 11 during coordinated control mode of controller system 100. Thus bucket 24 can be positioned with the bottom thereof level relative to surface 11, and maintained level while loader arms 20 are raised or lowered between loading and unloading operations, to prevent accidental spills. This is accomplished without manual control of the bucket 24 position by the operator. As a result, operation efficiency is improved, whereas fatigue to the operator is reduced.

During the loading and unloading operations of bucket 24, the control of loader arms 20 is preferably configured such that loader arms 20 remain essentially stationary. Thus, loading and unloading operations of bucket 24 generally occur when the independent bucket control mode of controller system 100 is active. More specifically, independent loader arm control mode and coordinated control mode are both typically inactive during operation of independent bucket control mode.

Independent bucket control mode is active when there is movement of joystick lever 65 about the second axis, with substantially no movement of lever 65 about the first axis, to generate a bucket velocity signal at input 132. The bucket velocity signal is representative of the desired bucket velocity. Thus, system 60 operates to rotate the bucket at a speed related to (e.g. proportional) the distance lever 65 is moved from its center position. The second control axis signal at input 132 is also applied to switch box 104. Switch box 104 gives active independent bucket control priority. More specifically, switch box 104 uses the bucket velocity axis control signal at input 132 as a basis to determine whether bucket 24 should follow loader arms 20 or should move independently. In particular, if the second control signal represents that lever 65 is at a non-zero position relative to the second axis, (i.e., independent bucket control mode is active) then bucket velocity signal at input 132 is applied directly to bucket velocity controller 128. However, if lever 65 is at its zero position (centered) relative to the second axis (i.e., independent bucket control mode is inactive), and coordinated control mode is active, then velocity signal at input 126 from PI controller 118 is applied to bucket velocity controller 128 from switch box 104. Under independent bucket control mode, switch box 104 is preferably configured to small set velocity signals at input 126 and small loader arm joystick velocity signals at input 102 to zero, thereby allowing only the axis bucket velocity signal at input 132 to be applied to bucket velocity controller 128.

As shown in FIG. 4, bucket velocity controller 128 further receives the bucket position signal at input 120 from bucket position sensor 70, thereby providing the current position of bucket 24 with respect to loader arms 20. In the independent bucket control mode, bucket velocity controller 128 integrates the signals at inputs 102 and 120. More specifically, bucket velocity controller 128 integrates both input signals such that a predetermined relationship (e.g. proportional) is maintained between the second axis control signal at input 132 and bucket position signal at input 120.

Bucket velocity controller 128 then generates the bucket valve signal at output 130 based upon the integral of the bucket velocity signal at output 132 and the bucket position signal at input 120. The bucket valve signal is a PWM signal applied to valve driver circuit 131 to control cylinder 32 as previously described in detail above. Accordingly, hydraulic cylinder 32 pivots bucket 24 to maintain the predetermined relationship between the bucket position signal at input 120 and the bucket velocity signal at output 132. Hydraulic cylinder 32 is also controlled so that the rate of change of bucket position signal at input 120 is substantially proportional to the rate of change of the bucket velocity signal at output 132. Thus, system 60 operates to tilt, pivot or rotate bucket 24 in accordance with the degree of motion of joystick lever 65 about the second axis.

In one embodiment, controller system 100 is configured to automatically switch between coordinated control mode and independent bucket control mode. However, this could be accomplished with a manual switch that the operator could control.

Figure 5:
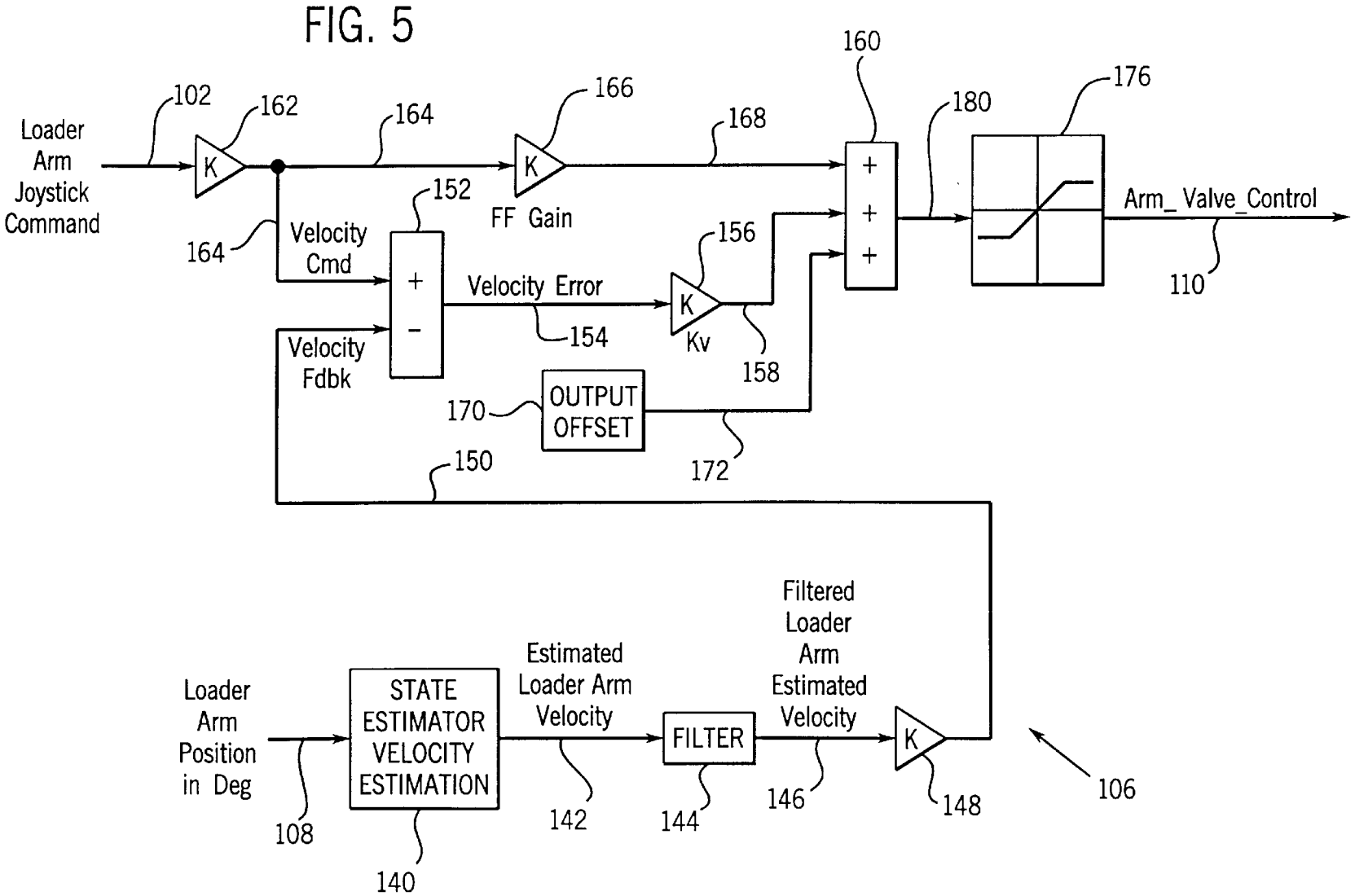
FIG. 5 is a block diagram of the loader arm velocity control circuit of the electronic control.

Referring to FIG. 5, loader arm velocity control 106 will be described in further detail. Control 106 uses the position signal at input 108 to estimate the current velocity of loader arms 20 with a velocity estimator 140 to generate an estimated loader arm velocity signal at output 142 from the loader position signal 108. Velocity estimator 140 is preferably configured to be a third order Lanczos-type filter. The Lanczos filter provides simultaneous velocity estimation and low pass filtering, which sharply reduces the noise as compared to a typical differentiator. Alternatively, if direct velocity feedback is available, such as, that produced by a tachometer, it can be used instead of the estimated velocity.

The velocity signal at output 142 is applied to a filter 144. Filter 144 is preferably a low pass filter that further removes high frequency noise, thereby preventing velocity controller 106 from reacting to false signals. Filter 144 subsequently generates a filtered estimated loader arm velocity signal at output 146. The signal at output 146 is then multiplied by a constant at amplifier 148 to produce a velocity feedback signal at output 150. Amplifier 148 typically uses a conversion factor that ensures unit compatibility between the current loader arm velocity estimated from position signal 108 and the loader arm velocity signal at input 102 generated as a result of joystick lever movement about the first axis. The signal at output 150 is applied to a summing circuit 150.

Loader arm velocity signal 102 is applied to an amplifier 162 which multiplies the signal by a constant which is a conversion factor used to scale the loader arm velocity signal, (e.g., degrees per second) to generate a scaled velocity signal at output 164. The signal at output 164 is applied to summing circuit 152, and a feedforward gain amplifier 166.

Circuit 152 is configured such that the velocity signal at output 164 is preferably designated a positive value, whereas the velocity feedback signal at output 150 is generally assigned a negative value. As a result, circuit 152 subtracts the velocity feedback signal from the velocity signal 164 to derive a velocity error signal at output 154. The velocity error signal is then multiplied with a standard control factor gain by amplifier 156. The control gain 156 represents the degree to which controller 106 reacts to error signal at output 154, i.e., the difference between the desired loader arm velocity signal at 164 and the estimated loader arm velocity signal at 150. The signal at the velocity error signal at 154 is multiplied by another control gain by amplifier 156. The output of amplifier 156 is coupled to a summing circuit 160.

Circuit 160 is also coupled to output 168. Output 168 provides a nominal valve-opening setpoint for the particular loader arm velocity signal applied to input 102. Additionally, circuit 160 is coupled to an output offset signal at input 172 generated by an offset circuit 170. Circuit 170 provides a biasing value necessary to ensure closure of the particular valve used in the independent loader arm control mode. More specifically, the output offset signal at 172 is the nominal valve-closing voltage required to close a particular valve, e.g., the loader arm valve 56. In one embodiment, offset signal 172 is configured to be 6 volts. Alternative configurations of loader arm velocity controller 106 may not require an offset term.

The signals applied to inputs 158, 168 and 172 are assigned positive values. As a result, the inputs to circuit 160 are added to generate an arm valve signal at output 180. To more accurately generate an output signal representative of the valve signal needed in response to a loader arm velocity signal at 102 and loader arm position signal at 108, circuit 160 requires the input signal from output offset circuit 170. More specifically, the output offset signal at 172 shifts the valve signal that would otherwise be generated by the sum of input 168 and output 158 by the nominal voltage needed to drive loader arm valve 56 of valve assembly 54 to its closed position, e.g., 6 volts. For example, at circuit 160, the value of the sum of inputs 158 and 168 can come to be the equivalent of zero volts, intending to command the closure of loader arm valve 56. However, zero volts would not be sufficient to drive loader arm valve 56 to close. Therefore, output offset signal at 172 is added as an input to circuit 160 to ensure that a more accurate signal at 110 is generated to effect the desired outcome.

The signal at output 110 is applied to a saturation or limiter circuit 176 arranged at the output of controller 106. Saturation circuit 176 maintains the output signal circuit 160 within maximum and minimum voltage limits of a work range within which velocity controller 106 operates the valves in valve assembly 54. In one embodiment, the maximum and minimum voltage output limits for the controller 106 work range are preferably 9 volts and 3 volts, respectively. Circuit 176 generates the loader arm valve signal at output 110 which is applied to valve driver 111 which controls the solenoids of valve 56 to control hydraulic fluid flow to hydraulic cylinders 28 to effect movement or nonmovement, respectively, of loader arms 20.

Figure 6:
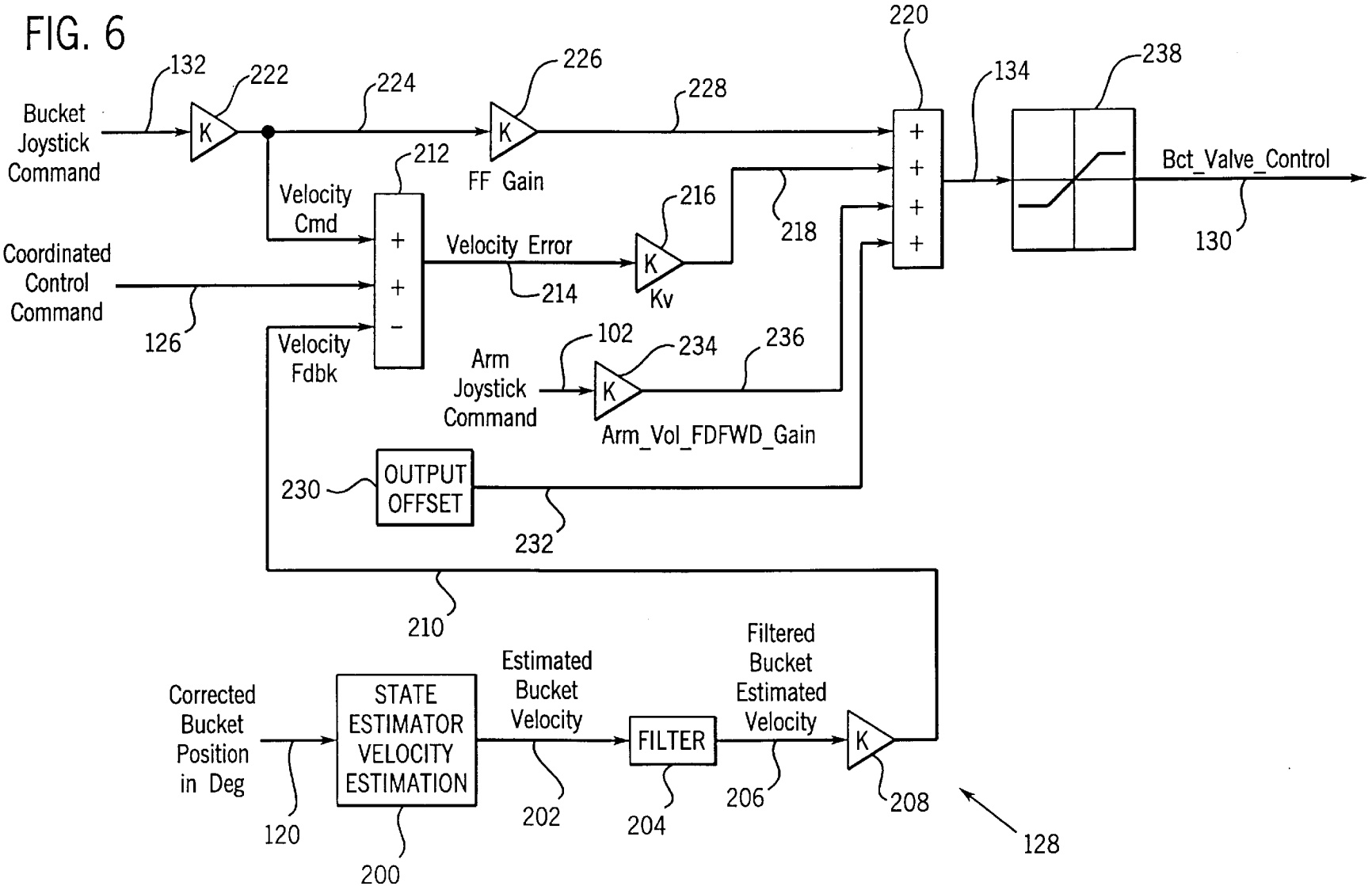
FIG. 6 is a block diagram of the bucket velocity control circuit of the electronic control.

Referring to FIG. 6, bucket velocity controller 128 is shown in further detail. The control logic used to operate bucket velocity controller 128 is substantially similar to the control logic used to operate loader arm velocity controller 106. The difference in the control operation of bucket velocity controller 128 depends upon the control mode under which system 60 is operating. As previously described with reference to FIG. 1, bucket velocity controller 128 operates during coordinated control mode and independent bucket control mode of system 60.

As previously discussed, controller 128 receives three input signals: the velocity signal generated by PI control 118 at output 126, the loader arm velocity signal at input 102, and the bucket position signal at output 120. In particular, during coordinated control mode, bucket joystick velocity signal 132 is unused (i.e., inactive), while the loader arm velocity command at input 102 and velocity signal at output 126 are applied by switch circuit 104 to controller 128.

As previously discussed, the bucket position signal at input 120 is processed and geometrically corrected before it is sent to bucket velocity controller 128. Bucket velocity controller 128 then uses the corrected bucket position signal at input 120 to estimate the current velocity of bucket 24. More specifically, velocity controller 128 utilizes a velocity estimator 200 to generate an estimated bucket velocity signal at output 202 from the bucket position signal 120. The velocity estimator 200 is preferably configured to be a third order Lanczos-type filter, substantially similar to the velocity estimator 140 used in the loader arm velocity controller 106. Alternatively, if direct feedback is available, such as, that produced by a tachometer, it can be used instead of the estimated velocity.

The estimated bucket velocity signal at output 202 is applied to a filter 204. Filter 204 is preferably a low pass filter that further removes high frequency noise, thereby preventing velocity controller 128 from reacting to false signals. Filter 204 is substantially similar to filter 144 used in loader arm velocity controller 106. Filter 204 generates a filtered estimated bucket velocity signal at output 206. The filtered estimated bucket velocity at output 206 is then multiplied by a constant by amplifier 208. The constant is typically a conversion factor that ensures unit compatibility between the current bucket velocity estimated from position signal 120 and the PI controller velocity signal at output 126 generated as a result of joystick lever 65 movement about the first axis, with substantially no second axis lever movement. When the filtered estimated bucket velocity signal is amplified by amplifier 208, the result is an actual bucket velocity feedback signal at output 210. The signal at 210 is applied to a summing circuit 212.

The velocity signal at output 126 is also applied to circuit 212. Circuit 212 subtracts the velocity feedback signal at output 210 from the velocity signal at output 126 to derive a velocity error signal at output 214. Velocity error signal 214 is then multiplied by a standard control gain by amplifier 216. The control gain represents the responsiveness of controller 128 to error signal 214. The output 218 of amplifier 216 is applied to a summing circuit 220.

As previously described with reference to system 60, the coordinated control mode preferably occurs when the independent loader arm control mode is active. As a result, bucket velocity controller 128 also receives the loader arm velocity signal at 102 as an input. Bucket velocity controller 128 multiplies velocity signal 102 by an arm velocity feedforward gain via amplifier 234 to generate an amplified signal at output 236. The signal at output 236 provides a nominal valve-opening setpoint for the particular loader arm velocity signal at 102, and is applied to circuit 220.

Circuit 220 also receives an output offset signal at input 232 generated by an offset circuit 230. Circuit 230 is similar to the output circuit 170 used in loader arm velocity controller 106, and provides biasing necessary to ensure closure of the valve used during coordinated control mode to control cylinder 32. More specifically, the signal at output 232 is the nominal valve-closing voltage required to close a particular valve, e.g., the bucket valve 58. In one embodiment, the offset signal at 232 is configured to be 6 volts.

The inputs to circuit 220 are added to generate bucket command signal at output 134. To more accurately generate an output signal at 134 representative of the valve signal needed in response to the coordinated control command 126, at the loader arm velocity command at 102, and the bucket position signal at 120, circuit 220 uses the input signal from output offset circuit 230. More specifically, the output offset signal at 232 shifts the command signal that would otherwise be generated by the sum of output 218 and output 236 by the nominal voltage (e.g. 6 volts) needed to drive bucket valve 58 of valve assembly 54 to its closure position. For example, the value of the sum of output 218 and output 236 can be equal to zero volts, ideally commanding the closure of bucket valve 58. However, zero volts will not typically be sufficient to drive bucket valve 58 closed. Therefore, the output offset signal at 232 is an input to circuit 220 to ensure that a more effective command at 134 is generated to effect the desired outcome.

The command at 134 is applied to a saturation or a limiter circuit 238 arranged at the output of controller 128. Circuit 238 maintains the valve signals between maximum and minimum voltage output limits of a work range within which velocity controller 128 operates the valve solenoids in valve assembly 54. In one embodiment, the maximum and minimum voltage output limits for the controller 128 work range are preferably 9 volts and 3 volts, respectively. The signal from circuit 238 is applied to hydraulic valve assembly 54 via valve driver 131 (see FIG. 3) to control hydraulic fluid flow to hydraulic cylinder 32 which effects movement or nonmovement of bucket 24.

Bucket velocity controller 128 also receives the bucket velocity signal at 132. During independent bucket control mode, the bucket velocity signal at 132 is nonzero (i.e., lever 65 is offset from its center position relative to the second axis).

The bucket velocity signal at output 132 is multiplied by a constant by amplifier 222 to similar to constant 208, i.e., it is a conversion factor used to scale the bucket velocity signal to correspond to a velocity in units of degrees per second. The velocity signal at output 224 is applied to summing circuit 212, and an amplifier 226 which multiplies the signal at 224 by a feedforward gain constant. The constants ensure that the bucket velocity signal and actual bucket velocity feedback signal are applied to circuit 212 with the same units.

Circuit 212 subtracts the velocity feedback signal at 210 from the velocity signal at 224 to derive a velocity error signal at output 214. Velocity error signal 214 is then multiplied by standard control gain by amplifier 216 to generate a signal at output 218 applied to circuit 220.

Circuit 220 further receives the signal from input 228. Circuit 220 adds the signals from inputs 218, 228, 232 and 236 to generate a command signal at 134. Signal 134 is then processed as described in detail above to ultimately control the motion of bucket 24.

It is understood that, while the detailed drawings, specific examples, and particular component values given describe preferred embodiments of the present invention, they serve the purpose of illustration only. For example, the control circuits and logic of system 60 are implemented with a programmed digital processor. However, the circuits and logic could also be implemented with analog circuiting. Furthermore, the PWM valve signals could be replaced with analog signals depending upon the valve drivers and valve solenoids used for a particular application. The apparatus of the invention is not limited to the precise details and conditions disclosed. Furthermore, other substitutions, modifications, changes, and omissions may be made in the design, operating conditions, and arrangement of the preferred embodiments without departing from the spirit of the invention as expressed in the appended claims.

What is claimed is:

1. A control for an implement of the type including at least one arm pivotally supported at a vehicle having a frame and an attachment pivotally attached to the arm, wherein the arm is pivoted relative to the vehicle by at least a first hydraulic actuator, and the attachment is pivoted relative to the arm by a second hydraulic actuator, the control comprising:

a first position sensor supported to generate a first position signal representative of the position of the arm relative to the vehicle;

a second position sensor supported to generate a second position signal representative of the position of the attachment relative to the arm;

an input device including an operator interface assembly moveable by an operator relative to first and second axes, the device including a first signal generator for generating a first control signal representative of motion of the interface assembly about the first axis and a second signal generator for generating a second control signal representative of motion of the interface assembly about the second axis;

a hydraulic valve assembly responsive to a first valve signal to control hydraulic fluid flow to at least the first hydraulic actuator, and responsive to a second valve signal to control hydraulic fluid flow to the second hydraulic actuator; and a digital control circuit coupled to the position sensors, the input device, and the hydraulic valve assembly to apply the first and second valve signals to the valve assembly such that hydraulic fluid flow is applied to at least the first hydraulic actuator to pivot the arm so that the first position signal and the first control signal maintain a first predetermined relationship, and hydraulic fluid flow is applied to the second hydraulic actuator to pivot the attachment so that the second position signal and the second control signal maintain a second predetermined relationship, wherein the second valve signal is generated independently of the second control signal when the interface assembly is only moved about the first axis such that the second hydraulic actuator pivots the attachment to maintain a third predetermined relationship between the attachment and the frame while the arm is pivoted by the first hydraulic actuator.

2. The control of claim 1, wherein the input device is a joystick, and the operator interface assembly is a lever.

3. The control of claim 2, wherein the first and second signal generators are first and second respective potentiometers coupled to the lever such that the first potentiometer is operated in response to motion of the lever about the first axis, and the second potentiometer is operated in response to motion of the lever about the second axis.

4. The control of claim 3, wherein the control circuit includes an analog-to-digital converter which converts the control signals generated by the potentiometers to digital control signals.

5. The control of claim 1, wherein the control circuit is configured such that the third predetermined relationship is a substantially constant angle between the attachment and the frame.

6. The control of claim 2, wherein the control circuit is configured such that the third predetermined relationship is a substantially constant angle between the attachment and the surface.

7. The control of claim 6, wherein the attachment is a bucket, and the hydraulic actuators are hydraulic cylinders.

8. The control of claim 2, wherein the hydraulic valve is a pulse-width-modulated (PWM) valve, and the control circuit is configured to generate first and second valve signals which are PWM signals.

9. The control of claim 2, wherein the control circuit is configured to apply the first and second valve signals to the valve assembly such that hydraulic fluid flow is applied to the first hydraulic actuator to pivot the arm so that the rate of change of the first position signal and the rate of change of the first control signal maintain a fourth predetermined relationship, and hydraulic fluid flow is applied to the second hydraulic actuator to pivot the attachment so that the rate of change of the second position signal and the rate of change of the second control signal maintain a fifth predetermined relationship.

10. The control of claim 9, wherein the control circuit is configured such that the first, second, fourth, and fifth predetermined relationships are proportional relationships.

11. The control of claim 10, wherein the fourth and fifth predetermined relationships are also integral relationships.

12. A loading system comprising:

first and second arms pivotally supportable at a vehicle having a frame;

a bucket pivotally attached to the arms;

first and second hydraulic cylinders for pivoting the first and second arms, respectively, relative to the vehicle;

least a third hydraulic cylinder for pivoting the bucket relative to the arms;

at least a first position sensor supported to generate a first position signal representative of the position of the arms relative to the vehicle;

at least a second position sensor supported to generate a second position signal representative of the position of the bucket relative to the arms;

a joystick including a lever moveable by an operator about first and second axes, a first signal generator for generating a first control signal representative of motion of the lever about the first axis, and a second signal generator for generating a second control signal representative of motion of the lever about the second axis;

a hydraulic valve assembly responsive to a first valve signal to control hydraulic fluid flow to the first and second hydraulic cylinders, and responsive to a second valve signal to control hydraulic fluid flow to at least the third hydraulic cylinder; and a digital control circuit coupled to the position sensors, the joystick, and the hydraulic valve assembly to apply the first and second valve signals to the valve assembly such that hydraulic fluid flow is applied to the first and second hydraulic cylinders to pivot the arms so that the first position signal and the first control signal maintain a first predetermined relationship, and hydraulic fluid flow is applied to at least the third hydraulic cylinder to pivot the bucket so that the second position signal and the second control signal maintain a second predetermined relationship, wherein the second valve signal is generated independently of the second control signal when the joystick is only moved about the first axis such that at least the third hydraulic cylinder pivots the bucket to maintain a predetermined orientation between the bucket and the frame while the arms are pivoted by the first and second hydraulic cylinders.

13. The control of claim 12, wherein the first and second signal generators are first and second respective potentiometers coupled to the lever such that the first potentiometer is operated in response to motion of the lever about the first axis, and the second potentiometer is operated in response to motion of the lever about the second axis.

14. The control of claim 13, wherein the control circuit includes an analog-to-digital converter which converts the control signals generated by the potentiometers to digital control signals.

15. The control of claim 12, wherein the control circuit is configured such that the predetermined orientation is a substantially constant angle between the bucket and the frame.

16. The control of claim 15, wherein the hydraulic valve is a pulse-width-modulated (PWM) valve, and the control circuit is configured to generate first and second valve signals which are PWM signals.

17. The control of claim 12, wherein the control circuit is configured to apply the first and second valve signals to the valve assembly such that hydraulic fluid flow is applied to the first and second hydraulic cylinders to pivot the arms so that the rate of change of the first position signal and the rate of change of the first control signal maintain a fourth predetermined relationship, and hydraulic fluid flow is applied to the third hydraulic cylinder to pivot the attachment so that the rate of change of the second position signal and the rate of change of the second control signal maintain a fifth predetermined relationship.

18. The control of claim 17, wherein the control circuit is configured such that the first, second, fourth, and fifth predetermined relationships are proportional relationships.

19. The control of claim 18, wherein the fourth and fifth predetermined relationships are also integral relationships.

20. A loading vehicle comprising:

a frame;

wheels for movably supporting the frame relative to a surface supporting the vehicle;

an engine supported by the frame;

a hydraulic pump coupled to the engine;

first and second arms pivotally supported by the frame;

a bucket pivotally attached to the first and second arms;

first and second hydraulic cylinders connected between the frame and the first and second arms, respectively, to pivot the arms;

at least a third hydraulic cylinder for pivoting the bucket relative to the arms;

at least a first position sensor coupled to at least one arm and the frame to generate a first position signal representative of the position of the arms relative to the vehicle;

at least a second position sensor coupled between at least one arm and the bucket to generate a second position signal representative of the position of the bucket relative to the arms;

a joystick including a lever moveable by an operator about first and second axes, a first signal generator for generating a first control signal representative of motion of the lever about the first axis, and a second signal generator for generating a second control signal representative of motion of the lever about the second axis;

a hydraulic valve assembly responsive to a first valve signal to control hydraulic fluid flow to the first and second hydraulic cylinders, and responsive to a second valve signal to control hydraulic fluid flow to at least the third hydraulic cylinder; and a digital control circuit coupled to the position sensors, the joystick, and the hydraulic valve assembly to apply the first and second valve signals to the valve assembly such that hydraulic fluid flow is applied to the first and second hydraulic cylinders to pivot the arms so that the first position signal and the first control signal maintain a substantially proportional first relationship, and hydraulic fluid flow is applied to at least the third hydraulic cylinder to pivot the bucket so that the second position signal and the second control signal maintain a substantially proportional second relationship, and wherein the second valve signal is generated independently of the second control signal when the joystick is only moved about the first axis such that at least the third hydraulic cylinder pivots the bucket to maintain a predetermined angle between the bucket and the frame while the arms are pivoted by the first and second hydraulic cylinders.

21. The vehicle of claim 20, wherein the first and second relationships are also a function of an integral of the difference between the respective first and second position signals and the first and second control signals.

22. The vehicle of claim 20, wherein the first and second signal generators are first and second respective potentiometers coupled to the lever such that the first potentiometer is operated in response to motion of the lever about the first axis, and the second potentiometer is operated in response to motion of the lever about the second axis.

23. The vehicle of claim 20, wherein the hydraulic valve is a pulse-width-modulated (PWM) valve, and the control circuit is configured to generate first and second valve signals which are PWM signals.

24. The vehicle of claim 20, wherein the control circuit is configured to apply the first and second valve signals to the valve assembly such that hydraulic fluid flow is applied to the first and second hydraulic cylinders to pivot the arms so that the rate of change of the first position signal and the rate of change of the first control signal maintain a predetermined fourth relationship, and hydraulic fluid flow is applied to at least the third hydraulic cylinder to pivot the attachment so that the rate of change of the second position signal and the rate of change of the second control signal maintain a predetermined fifth relationship.

25. The vehicle of claim 24, wherein the fourth and fifth relationships are also integral relationships.

* * * * *